US012643138B2

(12) United States Patent
Rugina et al.

(10) Patent No.: US 12,643,138 B2
(45) **Date of Patent: *Jun. 2, 2026**

(54) TURRET ROLL FORMERS, FORMING ROLLER CASSETTES AND RELATED ARTICLES AND METHODS

(71) Applicant: STRUCTA WIRE CORP., Vancouver (CA)

(72) Inventors: Narcis Rugina, Burnaby (CA); William Spilchen, White Rock (CA); Jeffrey Sacks, Vancouver (CA); Abraham J. Sacks, Vancouver (CA)

(73) Assignee: STRUCTA WIRE ULC, Vancouver (CA)

( * ) Notice: Subject to any disclaimer, the term of this patent is extended or adjusted under 35 U.S.C. 154(b) by 10 days.

This patent is subject to a terminal disclaimer.

(21) Appl. No.: 18/760,762

(22) Filed: Jul. 1, 2024

(65) Prior Publication Data

US 2024/0351085 A1 Oct. 24, 2024

Related U.S. Application Data

(63) Continuation of application No. 17/842,921, filed on Jun. 17, 2022, now Pat. No. 12,030,106.

(Continued)

(51) Int. Cl.
*B21D 5/08* (2006.01)
*B21B 13/16* (2006.01)

(52) U.S. Cl.
CPC ..... *B21D 5/083* (2013.01); *B21B 13/16* (2013.01)

(58) Field of Classification Search
CPC . B21D 5/08; B21D 5/083; B21D 5/14; B21D 5/16; B21B 31/08
See application file for complete search history.

(56) References Cited

U.S. PATENT DOCUMENTS 4,557,129 A * 12/1985 Lash ..... B21B 13/16 72/181
4,724,695 A 2/1988 Stoehr
(Continued)

FOREIGN PATENT DOCUMENTS

CN 106734225 B 12/2018
CN 111774420 A 10/2020

OTHER PUBLICATIONS

International Search Report and Written Opinion for PCT/CA2022/050975 dated Sep. 13, 2022, 9 pages.

(Continued)

*Primary Examiner* — Debra M Sullivan
(74) *Attorney, Agent, or Firm* — Cozen O'Connor

(57) ABSTRACT

A turret roll forming machine includes at least one turret assembly carrying multiple rows of tooling (e.g., forming rollers), rotatable about an axis to selectively align rows of tooling with an input or output. A transmission is accessible from an exterior of the turret assembly without disassembling of the turret assembly to perform a changeover of roll tooling and/or maintenance on gears, bearings, or shafts of the transmission. Thus, a chain drive may be employed, advantageously accommodating differing rotational speeds for top and bottom forming rollers of each pair of forming rollers, e.g. to reduce roll scuffing. Pairs of forming rollers may be provided as cassettes, which are removably coupleable to the turret assembly allowing quick and easy reconfiguration and/or servicing, minimizing negative effects of changeover. The turret assembly may be a unitary structure (e.g., a weldment) improving rigidity and increasing accuracy of roll forming operations.

18 Claims, 9 Drawing Sheets

Related U.S. Application Data

(60) Provisional application No. 63/212,360, filed on Jun. 18, 2021.

(56) References Cited

U.S. PATENT DOCUMENTS

| | | | |
|---|---|---|---|
| 5,823,036 | A | 10/1998 | Matsunaga |
| 6,200,392 | B1 | 3/2001 | Korbonski |
| 6,766,676 | B2 | 7/2004 | Gorski |
| 8,011,218 | B1 | 9/2011 | Schell et al. |
| 2016/0221056 | A1 | 8/2016 | Ernst De La Graete |
| 2021/0107046 | A1 | 4/2021 | Yang |

OTHER PUBLICATIONS

Non Final Office Action for U.S. Appl. No. 17/842,921, mailed Aug. 30, 2023, 11 pages.
Notice of Allowance for U.S. Appl. No. 17/842,921, mailed Mar. 6, 2024, 10 pages.
Canadian Office Action for Canadian Application No. 3,223,085, dated May 16, 2025, 5 pages.
Canadian 2nd Office Action, for Canadian Application No. 3 ,223,085, dated Nov. 25, 2025, 7 pages.

* cited by examiner

TURRET ROLL FORMERS, FORMING ROLLER CASSETTES AND RELATED ARTICLES AND METHODS

TECHNICAL FIELD

The present disclosure relates generally to tooling operable to form material (e.g., metal) into desired shapes, and more specifically to roll forming machinery employing sets of pairs of forming rollers, and including those that employ turret assemblies and/or cassettes of forming rollers, and to related articles and methods.

DESCRIPTION OF THE RELATED ART

Roll forming involves the rolling of material (also referred to as a workpiece), typically metal material, into a desired cross-sectional shape. The material passes through consecutive pairs of roll tooling, typically referred to as forming rollers or rolls, the forming rollers of each pair of forming rollers cooperating with one another to perform incremental portions of forming or bending. The material is operated on by a sequence of pairs of forming rollers until the desired cross section is realized. Roll forming is usually continuous with the material fed from a coil, or feed from an in-line fabrication stage.

A variety of cross-sectional profiles can be produced on a roll former, but each cross-sectional profile requires its own custom roll tooling. The roll tooling (e.g., forming rollers) is mounted on shafts which are typically held in bearing stands. The shafts are powered by mechanical drive systems. Typically, upper roll shafts are adjustable to provide a range of clearance between the upper and lower forming rollers of each pair to allow various thickness materials to be processed, as long as the same cross-sectional profile is desired.

Conventionally, roll forming machinery is available in two general styles. A first style employs straddle mounts, where bearing stands straddle the tooling. A second style employs a cantilever design, where both bearing stands are on a same side of the roll tooling. The straddle design is normally used for wider products, and for forming heavier materials. The cantilever design is better suited for narrow products with lighter loading.

If various cross-sectional profiles are produced on the same roll forming machinery, the roll tooling must be changed for each cross-sectional profile. Changing roll tooling can be a time consuming process resulting in several hours of downtime as the roll tooling is changed, and while adjustments are made to fine tune the tooling positions of the roll tooling to obtain the required dimensions, and hence quality. Along with downtime, changing the roll tooling also incurs the cost of skilled mechanics or operators, as well as the production of scrap material on each changeover. It is noted that with respect to changeover, the cantilever style roll forming machinery may be preferable over the straddle style rolling forming machinery since the shafts and bearings do not have to be removed and the roll tooling can simply be slid off and the next set of roll tooling slid onto the shafts. The cantilever style saves some time on change over relative to the straddle style, but the changing the roll tooling is still time consuming with the cantilever style roll forming machinery.

There are situations where multiple cross-sectional profiles are produced on the same machine (e.g., up to 6 or 8 cross-sectional profiles) and there are multiple changeovers required on a daily basis to meet customer needs. If there are two or three changeovers per day, and 2 to 3 hours per changeover, total downtime per day can range from 4 to 9 hours per 24 hour day. In many instances, this is unacceptable so various approaches have been devised to limit such lost time. For example, some approaches employ rafts with a second set of stands and roll tooling that can be moved into position, or even in some cases a complete second roll former machine that can be moved in and out of a production line. These solutions are costly, take up space, and can usually only address two different product cross-sectional profiles.

BRIEF SUMMARY

A turret roll forming machine is described which includes at least one turret assembly that carries multiple rows of tooling (e.g., forming rollers), the turret assembly rotatable about an axis of rotation to selectively align a row of tooling with at least one of an input feed location or output feed location of a production line or of the turret roll forming machine.

The turret roll forming machine includes a frame, turret assembly rotatably mounted to the frame, a plurality of sets of pairs of forming rollers carried by the turret assembly, and a drive system including a motor and power drive train or transmission coupleable to drive selective sets of the pairs of forming rollers.

A power drive train or transmission may advantageously be positioned to be accessible from an exterior of the turret assembly, for example mounted or positioned on or outward of the exterior to the turret assembly. The drive system can include one or more motors, gears or sprockets, and/or chains. One of the benefits of this approach is that the turret assembly does not need to be disassembled in order to perform a changeover of roll tooling and/or to perform maintenance on the gears, bearings, or shafts of the transmission. This eliminates the time consuming and costly process of disassembling the turret assembly. In at least some of the illustrated and/or described implementations, the turret roll forming machine can advantageously be completely serviced without disassembly of the turret assembly.

Positioning the power drive train or transmission to be accessible from an exterior of the turret assembly advantageously allows a chain drive to be employed to drive the forming rollers. The use of a chain drive advantageously allows the freedom to design for differing rotational speeds of a top forming roller and a bottom forming roller of each pair of forming rollers. The ability to accommodate variations in speed between the rollers of any given pair is typically not possible with gear driven roll forming machines. This feature may be particularly advantageous when V-shapes are being formed in material. A pair of rollers that cooperate to form a V-shape in material will each have a respective diameter at the point of a respective V-shaped tip. Assuming the V-shaped is oriented with the open legs upward, and closed tip downward, the upper forming roller that forms the interior angle of the V-shape will have a smaller or tighter diameter than the lower forming roller that forms the exterior angle of the V-shape. If the two forming rollers are positioned tight together to form a sharp corner, there is a disparity in surface speed, which results in roll scuffing on the product being rolled and potential damage to the resulting product. Such can be alleviated using the described approach which permits differences in speeds between forming rollers of a given pair of forming rollers.

An additional advantage of positioning the power drive train or transmission to be accessible from an exterior of the turret assembly is that the power train components may be easily lubricated without risk of leaks or lack of lubrication on some portions thereof.

In at least some implementations, pairs of forming rollers may be provided as cassettes of forming rollers, which are removably coupleable to the turret assembly. Each cassette of forming rollers may carry one or more pairs of forming rollers, the forming rollers of each pair positioned to cooperate with one another to produce a change (e.g., bend, cut) in material passing therebetween. Successive pairs of forming rollers in a set may apply successive, and in some instances incremental changes in the material to produce a final desired cross-sectional profile. The use of cassettes of forming rollers may advantageously allow the turret roll forming machine to be quickly and easily reconfigured to produce a desired cross-sectional profile. Each cassette of forming rollers may carry one or more bearings, shafts, and/or shaft housings, worn or broken components of the transmission to be quickly and easily replaced, reducing downtime and cost of repair. The cassettes are preferably preassembled, facilitating quickly exchange.

One of the advantages of positioning the power drive train or transmission to be accessible from an exterior of the turret assembly and/or of the cassettes is that a changeover can be accomplished in minutes rather than hours, that a machine operator could perform the changeover and would not require a skilled technician, and that virtually no scrap would be created on each changeover.

In at least some implementations, the turret assembly is a unitary structure, rather than being a bolted assembly. For example, the turret assembly may be a weldment (i.e., one or more parts welded together) or may be a cast or extruded single-piece construction. This approach advantageously provides more rigidity and strength then bolted turret assemblies, and eliminates the risk of bolts vibrating loose. Improved rigidity and strength reduces flexing, thereby advantageously increasing accuracy of roll forming operations.

In at least some implementations, a production line may include one or more (e.g., ten) instances of turret roll forming machines at one or more respective roll stations, for example spaced successively along the production line. For example, to obtain more than, for example, four (4) different cross-sectional profiles, two or three turret assemblies could be arranged in tandem to achieve 4, 8 or 12 or more sets of preset tooling, for instance eliminating or reducing time lost in changeovers.

In at least some implementations, a master turret or carousel may carry a plurality of turret assemblies. The master turret or carousel coupled be rotated about a respective rotational axis to select a turret assembly with a desired set of tooling (e.g., set of pairs of forming rollers), and the selected turret assembly rotated about a respective rotational axis to align the desired set of tooling with at least one of an input feed location or output feed location of a production line.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with metal fabrication and forming have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The term "aligned" as used herein in reference to two elements along a direction means a straight line that passes through one of the elements and that is parallel to the direction will also pass through the other of the two elements. The term "between" as used herein in reference to a first element being between a second element and a third element with respect to a direction means that the first element is closer to the second element as measured along the direction than the third element is to the second element as measured along the direction. The term "between" includes, but does not require that the first, second, and third elements be aligned along the direction.

The term "plurality" as used herein means more than one. The terms "a portion" and "at least a portion" of a structure include the entirety of the structure.

The headings and Abstract of the Disclosure provided herein are for convenience only and do not interpret the scope or meaning of the embodiments.

Figure 1:
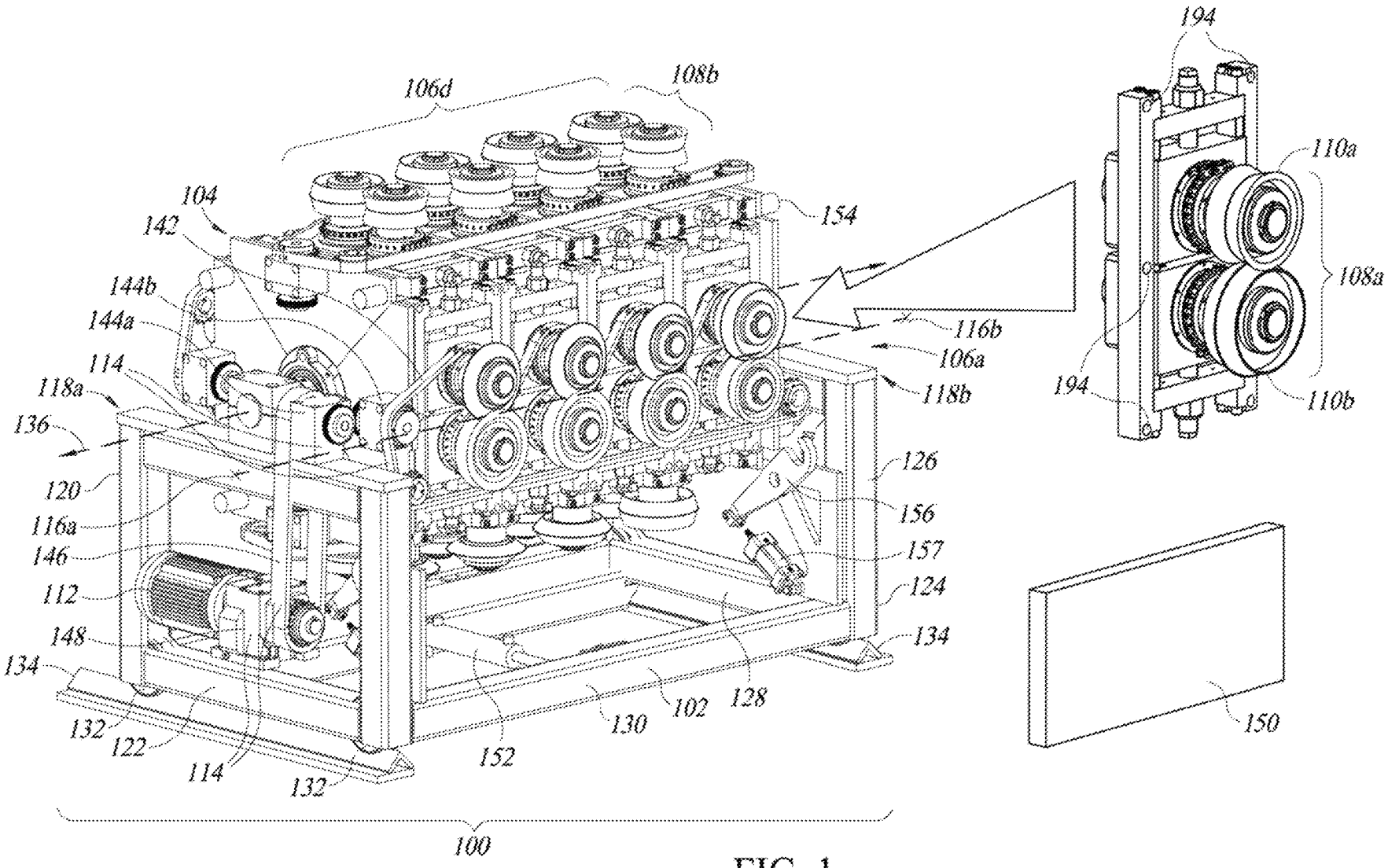
FIG. 1 is an isometric view of a roll forming machine including a frame, a turret assembly mounted to the frame, a plurality of sets of pairs of forming rollers carried by the turret assembly, and a drive system including a motor and a transmission, according to an embodiment, with a detailed illustration of a cassette of one pair of the forming rollers.
Figure 2:
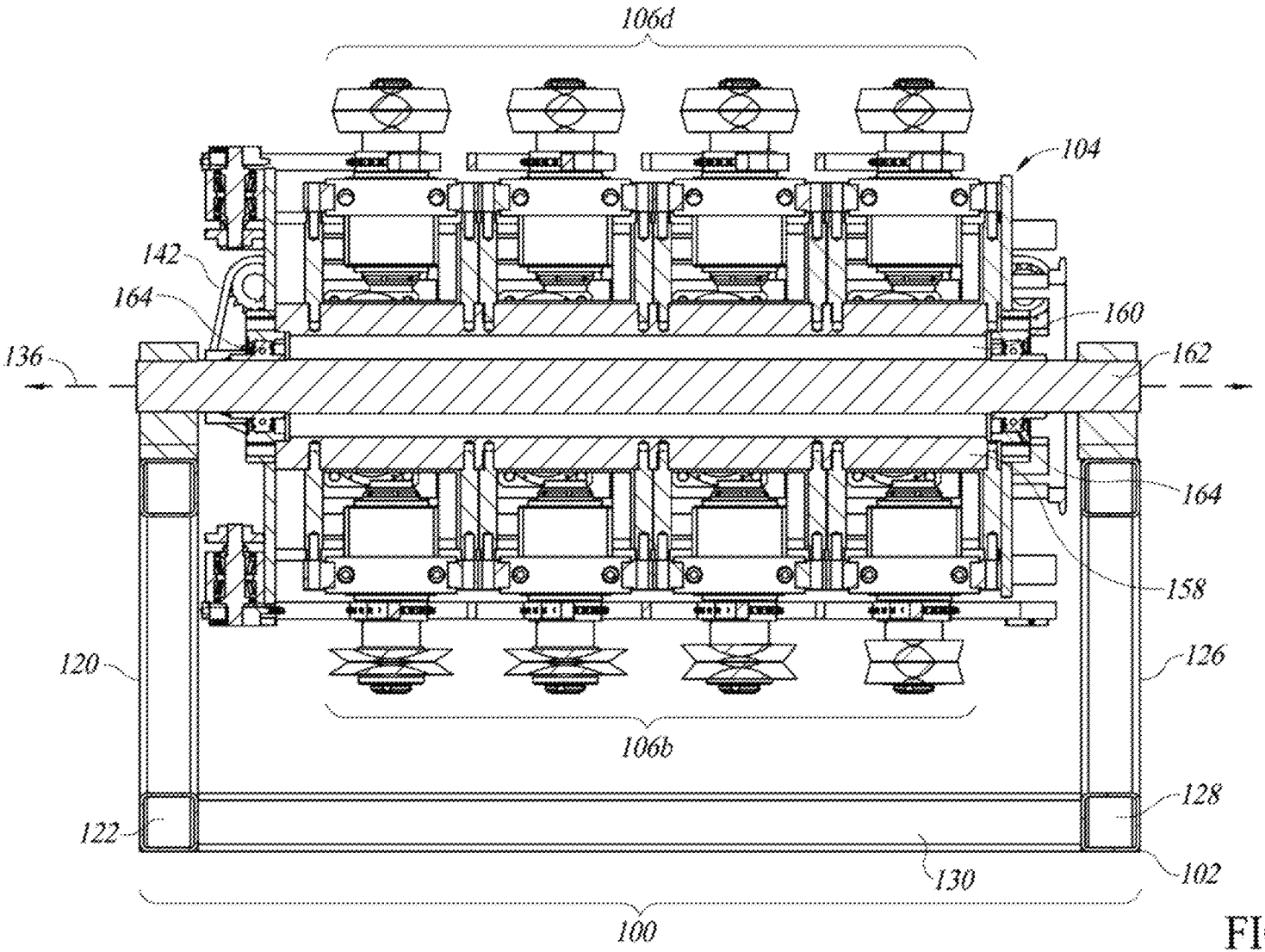
FIG. 2 is a cross-sectional view of the frame, the turret assembly, the sets of pairs of forming rollers, and part of the transmission of the roll forming machine illustrated in FIG. 1 taken along a vertical plane that extends through a rotational axis of the turret assembly.
Figure 3:
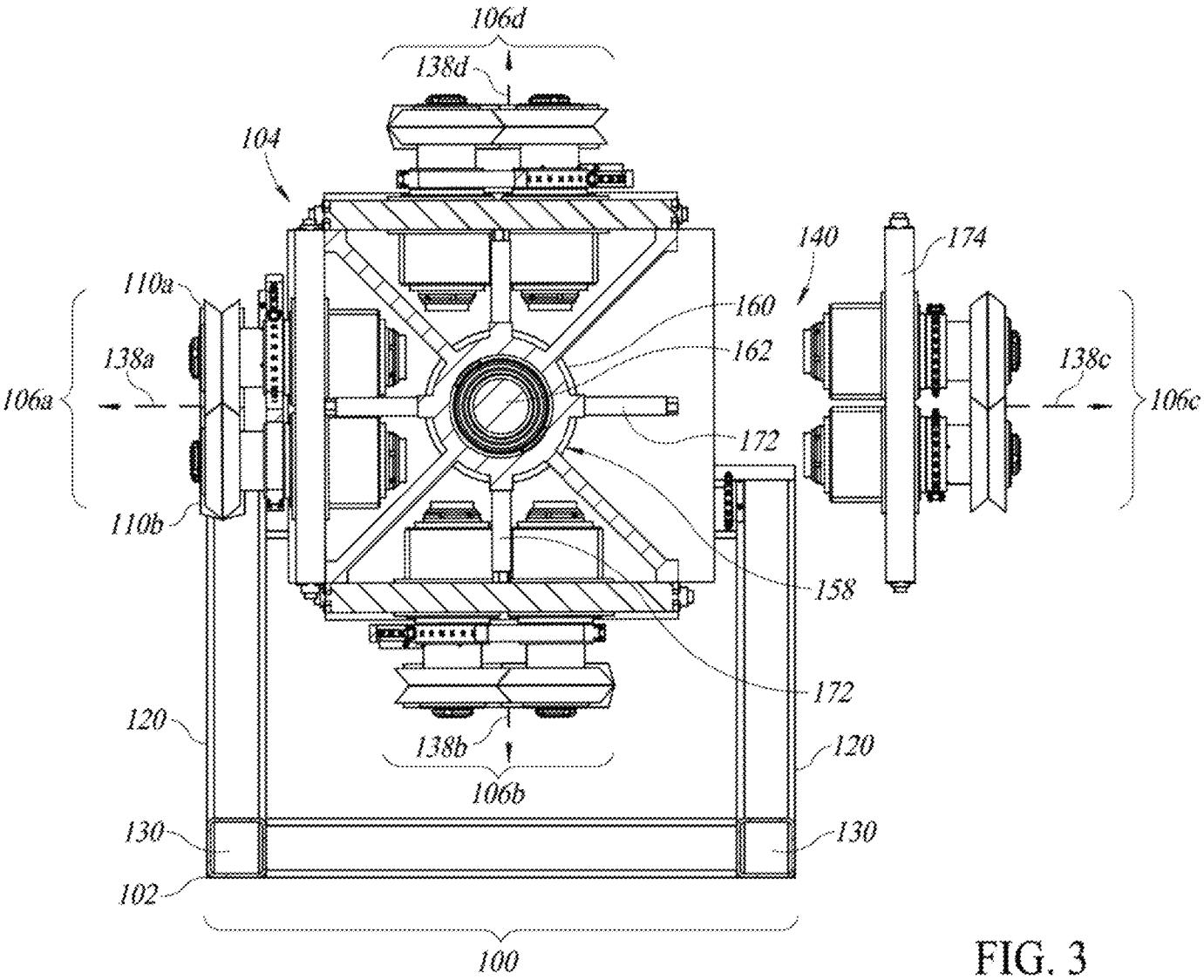
FIG. 3 a cross-sectional view of the frame, the turret assembly, the sets of pairs of forming rollers, and part of the transmission of the roll forming machine illustrated in FIG. 1 taken along a vertical plane that is perpendicular to the rotational axis of the turret assembly and passes through a center point along the rotational axis.
Figure 4:
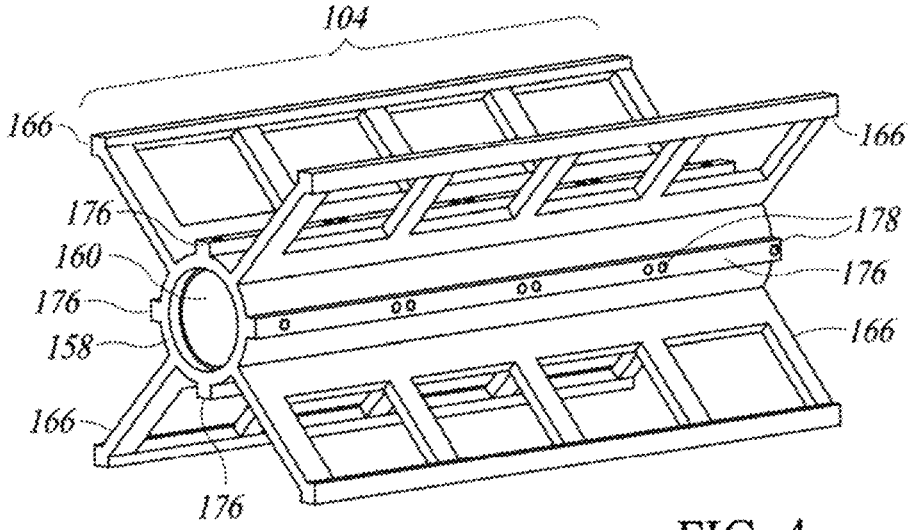
FIG. 4 is an isometric view of a portion of a turret assembly that includes a tube and a plurality of brackets that extend laterally outwardly from an outer perimeter of the tube, each of the brackets comprising a number of attachment features to allow detachably coupling of each of a number of cassettes of forming rollers to the turret assembly, according to at least one illustrated embodiment.
Figure 5:
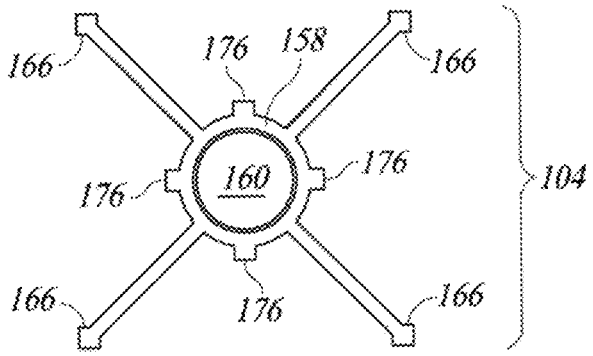
FIG. 5 is an end elevational view of the portion of a turret assembly illustrated in FIG. 4.
Figure 6:
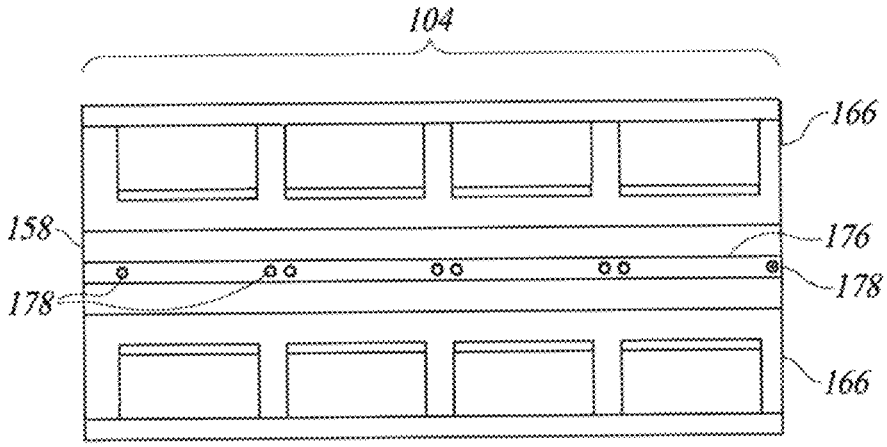
FIG. 6 is a side elevational view of the portion of a turret assembly illustrated in FIG. 4.

FIGS. 1, 2, and 3 show a roll forming machine 100, according to at least one illustrated implementation.

The roll forming machine 100 includes a frame 102; a turret assembly 104; a plurality of sets 106*a*, 106*b*, 106*c*, 106*d* (four sets shown, collectively 106) of one or more pairs 108*a*, 108*b* (four pairs per set illustrated, only two pairs called out in FIG. 1, collectively 108) of forming rollers 110*a*, 110*b* (only two forming rollers called out called out in FIGS. 1 and 3, collectively 110); a drive motor 112 (shown in FIG. 1); and a transmission 114 (called out in FIG. 1) that drivingly couples the drive motor 112 selectively to one of the sets 106 of the forming rollers 110 at a time. As explained herein, the turret assembly 104 may be selectively rotated to align any given set 106 of pairs 108 of forming rollers 110 with a desired position or orientation, for instance aligned with one or both of an input feed 116*a* (shown in FIG. 1) and an output feed 116*b* (shown in FIG. 1) of a production line.

The frame 102 may have a large variety of shapes, sizes and/or forms. In the illustrated implementation, the frame 102 includes a front rectangular end 118 (called out in FIG. 1) formed by upright members 120 (two shown, only one called out) and horizontal members 122 (two shown, only one called out), a rear rectangular end 124 formed by upright members 126 (two shown, only one called out) and horizontal members 128 (two shown, only one called out), and a number of longitudinal members 130 (two shown, only one called out) that couple the front rectangular end 118 and rear rectangular end 124 together. The horizontal members 122 may include a front top plate and a back top plate which extend horizontally across the front rectangular end 118 and rear rectangular end 124 of the frame 102, respectively. The various members of the frame 102 are preferably welded together to form a stiff and rigid unitary structure. The frame 102 may include a number of rollers or wheels 132, (shown in FIG. 1) and may be mounted on rails 134 (shown in FIG. 1) to allow the roll forming machine 100 to be translated, for instance translated with respect to a portion of a production line (e.g., input feed 116*a*, output feed 116*b*). In such an implementation, the roll forming machine 100 optionally includes one or more actuators 152 (shown in FIG. 1) positioned and operable to cause the frame to translate on the rails 134. The one or more actuators 152 may, for example, include one or more hydraulic pistons and cylinders, valves and/or pressurized reservoir of hydraulic fluid, and associated plumbing.

The turret assembly 104 has a turret rotational axis 136 (shown in FIGS. 1 and 2). The turret assembly 104 is rotatably mounted to the frame 102 for rotation about the turret rotational axis 136 with respect to the frame 102. Some specific examples of the rotatable mounting of the turret assembly 104 to the frame 102 are described herein. The roll forming machine 100 optionally includes a locking mechanism operable to secure the turret assembly 104 in a desired rotational orientation. In the illustrated implementation, the locking mechanism includes a number of pins 154 (two of four visible in FIG. 1, one called out) extending from the turret assembly 104, a number of hooks 156 (two of two visible in FIG. 1, one called out) pivotally coupled to the frame 102, and optional a bias member 157 (one of two visible in FIG. 1) that biases the hook(s) into an locked or engaged position with the respective pin(s). In other implementations, the pins 154 may extend from the frame 102 and the hooks 156 coupled to the turret assembly 104. The bias member 157 may take a variety of forms, for example springs, solenoids, piston and cylinders, to name a few. Other types of restraints (e.g., pin or rod slides into hole; threaded fastener) could be employed as a locking mechanism.

In the illustrated implementation, the sets 106 of one or more pairs 108 of forming rollers 110 includes four distinct sets, a first set 106*a* of one or more pairs 108 of forming rollers 110, a second set 106*b* of one or more pairs 108 of forming rollers 110, a third set 106*c* of one or more pairs 108 of forming rollers 110, and a fourth set 106*d* of one or more pairs 108 of forming rollers 110, Other implementations may include less than four sets 106 or more than four sets 106 of pairs 108 of forming rollers 110. The pairs 108 of forming rollers 110 of each set 106 are sequentially arranged extending along the turret rotational axis 136, the forming rollers 110 of the each set 106 laterally spaced outwardly from the turret rotational axis 136 in a respective lateral direction (e.g., forming rollers 110 of the first set 106*a* are spaced laterally outwardly in a first lateral direction 138*a* (illustrated in FIG. 3), forming rollers 110 of the second set 106*b* are spaced laterally outwardly in a second lateral direction 138*b* (illustrated in FIG. 3), forming rollers 110 of the third set 106*c* are spaced laterally outwardly in a third lateral direction 138*c* (illustrated in FIG. 3), and forming rollers 110 of the fourth set 106*d* are spaced laterally outwardly in a fourth lateral direction 138*d* (illustrated in FIG. 3).

The turret assembly 104 has been illustrated with a substantially square profile, with two of the sets 106*a*, 106*d* of the pairs 108 of forming rollers 110 diametrically opposed to one another across the turret rotational axis 136 and the other two of the sets 106*b*, 106*c* of the pairs 108 of forming rollers 110 diametrically opposed to one another across the turret rotational axis 136. Such is not intended to be limiting. Some implementations may include only two sets 106 of the pairs 108 of forming rollers 110 diametrically opposed to one another across the turret rotational axis 136. Other implementations may have a hexagonal profile with six sets 106 of the pairs 108 of forming rollers 110 with pairs of the sets 106 diametrically opposed to one another across the turret rotational axis 136, or even an octagonal profile with eight sets 106 of the pairs 108 of forming rollers 110 with pairs of the sets 106 diametrically opposed to one another across the turret rotational axis 136. Other implementations may employ an odd number of sets 106 of pairs 108 of forming rollers 110.

The forming rollers 110 of each pair 108 in a given set 106 are arranged to cooperate with one another to perform a respective rolling forming operation on material passing therebetween. The pairs 108 of forming rollers 110 of each set 106 are arranged relative to one another along the turret rotational axis 136 to successively perform respective roll forming operations as material sequentially passes through the pairs 108 of forming rollers 110 from a location of the input feed 116*a* to a location of the output feed 116*b*.

As explained herein and as best illustrated by the detailed view of FIG. 1, each pair of forming rollers 110 may be part of a respective cassette 174 (called out detailed view of FIG. 1) of forming rollers 110, each cassette 174 of forming rollers 110 advantageously detachably coupleable to the turret assembly 104 as a unit.

In at least some implementations, the transmission 114 is accessible from an exterior 140 (FIG. 3) of the turret assembly 104 without dismantling of the turret assembly 104. For example, a portion or preferably all of the transmission 114 is positioned externally to the turret assembly 104.

In the illustrated implementation, the transmission 114 advantageously comprises a forming roller drive chain 142. The forming roller drive chain 142 (shown in FIG. 1) may be positioned externally to the turret assembly 104. The transmission 114 may further comprises one or more transfer shafts 144*a* (shown in FIG. 1) and a main drive chain 146 (shown in FIG. 1) drivingly coupled between the drive motor 112 and the one or more transfer shafts 144*b*. The transfer shafts 144*a*, 144*b* and/or the main drive chain 146 may be positioned externally to the turret assembly 104. The forming roller drive chain 142 is drivingly coupled between the one or more transfer shafts 144*b* and a selected one of the sets 106 of one or more pairs 108 of forming rollers 110. The transmission 114 may further comprise a gear reducer 148 (shown in FIG. 1) drivingly coupled between the drive motor 112 and the main drive chain 146. The gear reducer 148 may be positioned externally to the turret assembly 104.

The forming roller drive chain 142 is preferably accessible from the exterior of the turret assembly 104 without dismantling of the turret assembly 104. The one or more transfer shafts 144*a*, 144*b* is preferably accessible from the exterior 140 of the turret assembly 104 without dismantling of the turret assembly 104. The main drive chain 146 is preferably accessible from the exterior 140 of the turret assembly 104 without dismantling of the turret assembly 104. The gear reducer 148 is preferably accessible from the exterior 140 of the turret assembly 104 without dismantling of the turret assembly 104.

The roll forming machine 100 may optionally include one or more chain guards 150 (show removed in FIG. 1) detachably coupleable to the turret assembly 104 to overlie the forming roller drive chain 142 when the forming roller drive chain 142 is positioned to drivingly engage the forming rollers 110 of one of the sets 106 of pairs 108 of forming rollers 110. The forming roller drive chain 142 may be positioned to be manually engageable selectively with the forming rollers 110 of a selected one of the sets 106 of one or more pairs 108 of forming rollers 110 on removal of the chain guard 150 and advantageously without dismantling of the turret assembly 104.

As best illustrated in FIGS. 2 and 3, the turret assembly 104 comprises a tube 158 mounted to rotate about the turret rotational axis 136 with respect to the frame 102. The tube 158 may advantageously be a unitary structure. For example, the tube 158 may be a weldment (i.e., one or more portions secured to one another or to itself by a weld); a cast metal single-piece construction; or an extrusion single-piece construction. The tube 158 has a passage 160 (also referred to as central passage) extending therethrough.

The turret assembly 104 may further comprise at least one shaft 162 that is coaxial with the turret rotational axis 136. In the illustrated implementation, the tube 158 is a cylindrical tube having the passage 160 extending longitudinally therethrough, and the at least one shaft 162 is received through the passage 160 of the tube 158 and extends out of both ends of the tube 158. A number of bearings 164 (e.g., ball bearings, cylindrical bearings, metal bearings, ceramic bearings, bearing races) are located at each end of the tube 158, and rotatable mount the tube 158 to the shaft 162 such that the tube 158 is able to rotate about the turret rotational axis 136 with respect to the shaft 162. The bearings 164 should be sufficiently strong to support the weight of the turret assembly 104 and any forces applied to the frame 102 via the turret assembly 104.

The shaft 162 is fixedly mounted to the frame 102 such that the shaft 162 does not rotate or translate with respect to the frame 102. The shaft 162 thereby supports the remainder of the turret assembly 104 from an upper portion of the frame 102. Brackets or other securement structures may be employed to secure the shaft 162 to the frame 102. Thus, the tube 158 is able to rotate about the turret rotational axis 136 with respect to the shaft 162 and frame 102.

As best illustrated in FIGS. 3, 4, 5 and 6, the turret assembly 104 comprises a plurality of brackets 166 that extend laterally outwardly from an outer perimeter 168 of the tube 158. Each of the brackets 166 comprises a number of attachment features 170 (e.g., holes, threaded holes, slots, pins). The attachment features 170 are positioned and operable to allow detachably coupling of each of a number of cassettes 174 of forming rollers 110 to the turret assembly 104 via the attachment features 170 of the brackets 166. Each cassette 174 of forming rollers 110 is detachably coupleable to the brackets 166 as a unit, for example via a number of fasteners (e.g., threaded bolts, screws, clamps).

The brackets 166 and the tube 158 are preferably a unitary structure, for example a weldment, or unitary single-piece construction casting. The brackets 166 and the tube 158 are preferably arranged such that, when each cassette 174 of forming rollers 110 is detachably coupleable to a respective pair of the brackets 166, the pair of brackets 166 and the respective cassettes 174 form a triangular structure (best shown in FIG. 3), the cassette 174 spanning between the distal ends of a pair of brackets 166.

The turret assembly 104 may include a number of ribs 176 that extend from the outer surface of the tube 158, and which extend along a length of the tube 158. The ribs 176 may include a number of attachment features 178 (e.g., holes, threaded holes, slots, pins).

As best illustrated in FIG. 3, the turret assembly 104 further comprises a plurality of tie rods 172 that extend laterally from the tube 158. The tie rods 172 may, for example, be physically coupled (e.g., threadedly engaged) at one end thereof to the tube 158 via the attachment features 178 of the ribs 176. The tie rods 172 may, for example, be detachably physically coupled (e.g., threadedly engaged) at the other end thereof to the cassettes 174 of forming rollers 110, thereby further securing the cassettes 174 to the tube 158 of the turret assembly 104.

Figure 7:
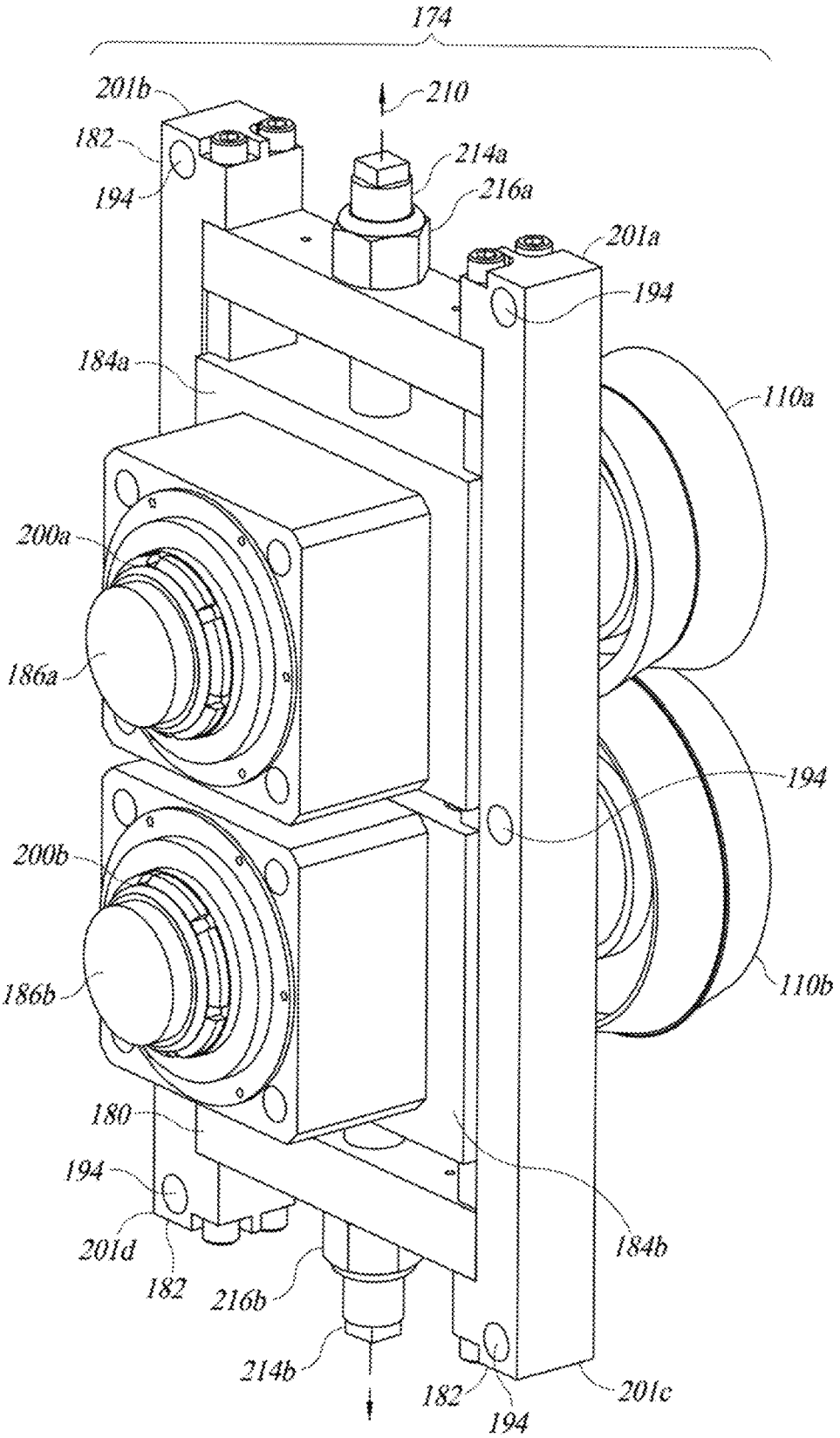
FIG. 7 is a rear, side isometric view of a cassette of forming rollers to be used with a turret assembly, the cassette including a pair of forming rollers, portions of a transmission, and attachment features positioned and operable to allow detachably couple the cassette of forming rollers to the turret assembly, according to at least one illustrated embodiment.
Figure 8:
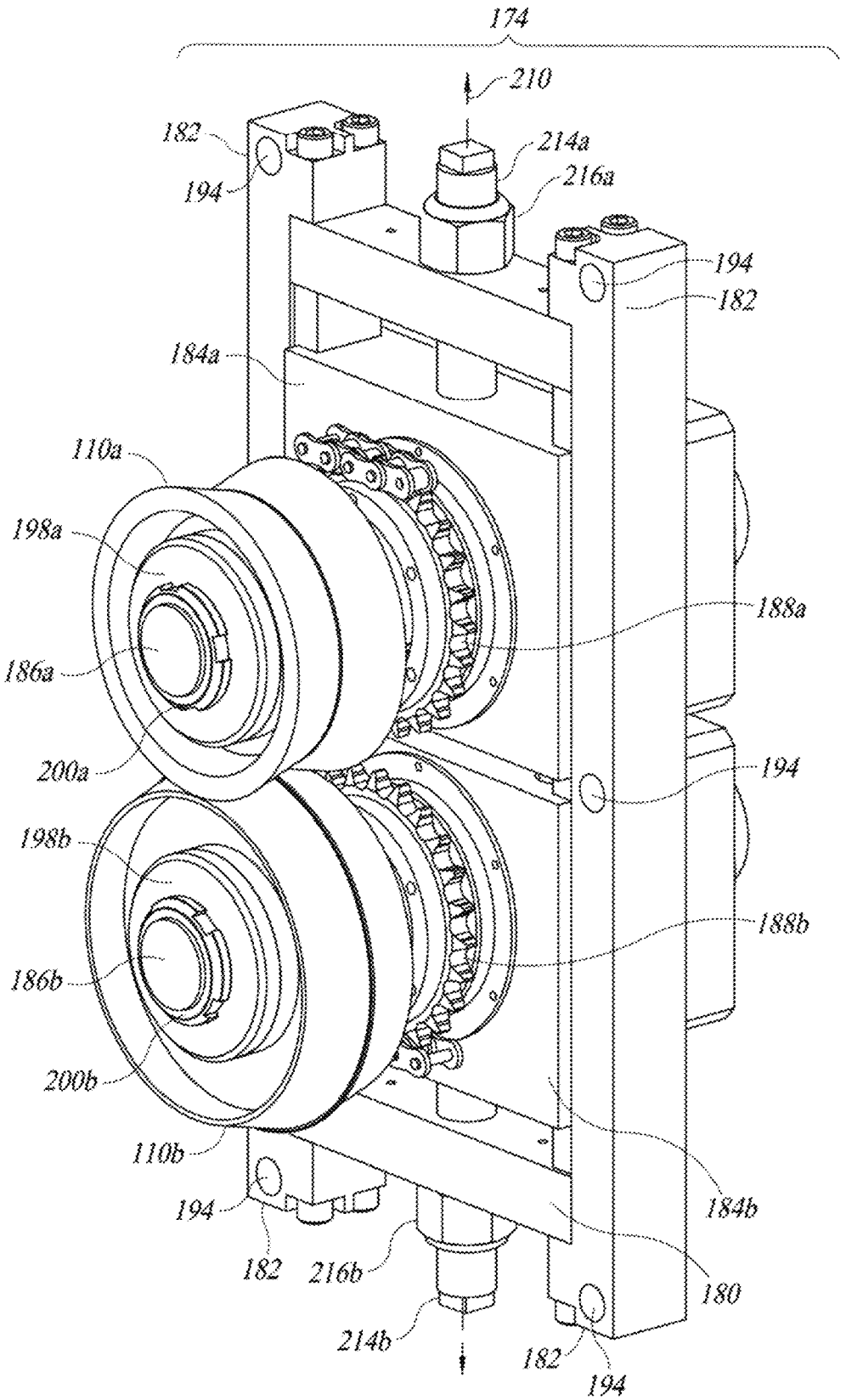
FIG. 8 is a front, side isometric view of the cassette of forming rollers illustrated in FIG. 7.
Figure 9:
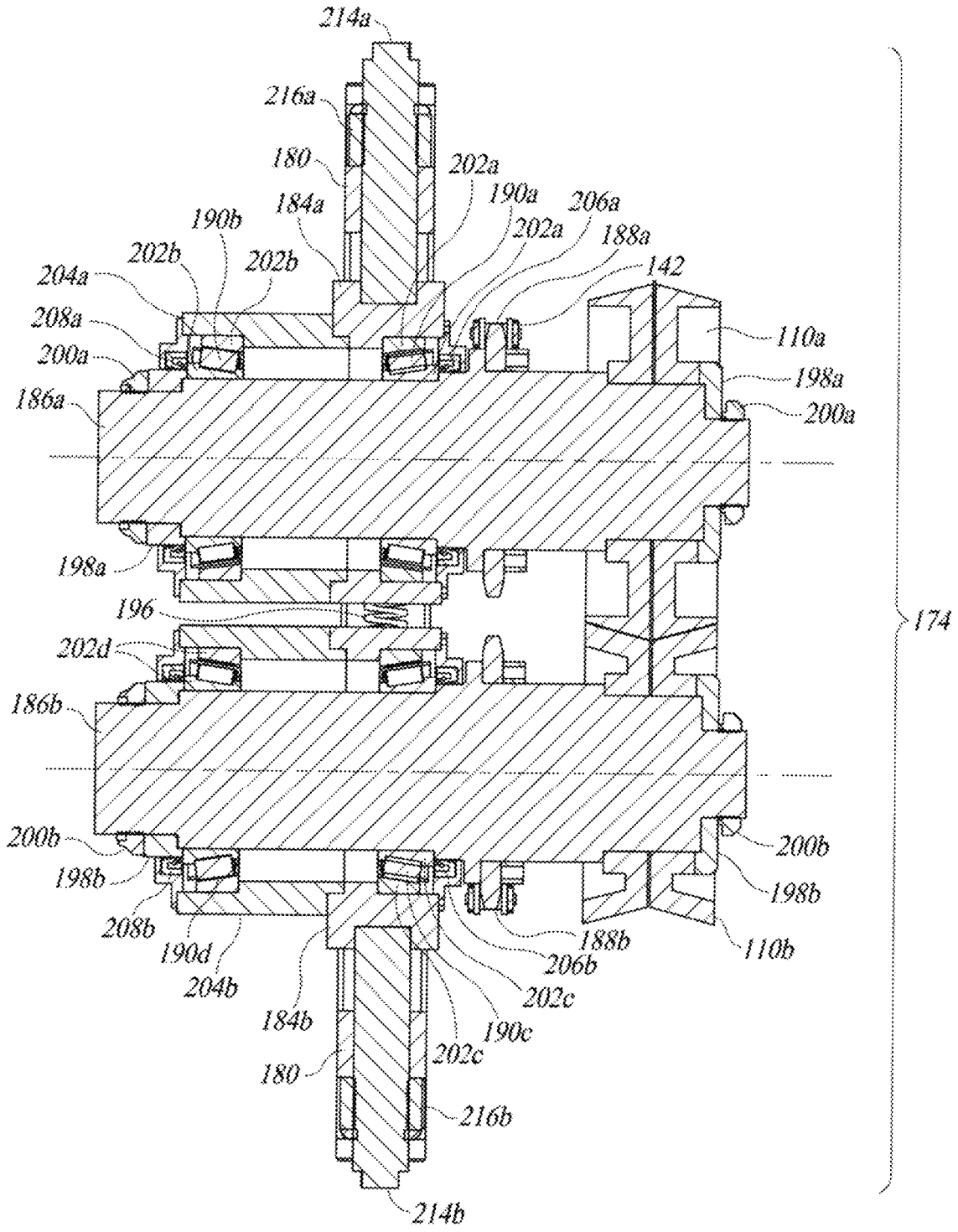
FIG. 9 is a cross-sectional view of the cassette of forming rollers illustrated in FIG. 7.

As best illustrated in FIGS. 7, 8, and 9, each pair of forming rollers 110 may be part of a respective cassette 174 of forming rollers 110, each cassette 174 of forming rollers 110 detachably coupleable to the turret assembly 104 (FIGS. 1-6) as a unit.

Each cassette 174 of forming rollers 110 comprises a respective cassette frame 180 with a plurality of attachment points 194 (also interchangeably referred to or attachment features). The cassette frame 180 may hold or support or otherwise carry a first block 184*a* and a second block 184*b*. Each cassette 174 may include a first shaft 186*a* and a second shaft 186*b* rotatably mounted to the first block 184*a* and the second block 184*b*, respectively. Each cassette 174 may include a first chain sprocket 188*a* and a first forming roller 110*a* of a respective pair of forming rollers 110 coupled to the first shaft 186*a* to rotate therewith when driven, and a second chain sprocket 188*b* and a second forming roller 110*b* of the respective pair of forming rollers 110 coupled to the second shaft 186*b* to rotate therewith when driven. The first forming roller 110*a* and the second forming roller 110*b* are arranged to complementarily cooperate with one another to perform a respective rolling forming operation on material that passes between the first forming roller 110*a* and the second forming roller 110*b*. Each cassette 174 of forming rollers 110 may include retainers 198*a*, 198*b* (best visible in FIGS. 8 and 9) and/or lock nuts 200*a*, 200*b* (best visible in FIGS. 8 and 9) attached to outer ends of the first shaft 186*a* and the second shaft 186*b* to secure the forming rollers 110*a*, 110*b* to the first shaft 186*a* and the second shaft 186*b*. In some implementations, an interference fit or high interference fit or shrink fit exists between an inner passage of the forming rollers 110*a*, 110*b* and an outer perimeter of the first shaft 186*a* and the second shaft 186*b*, respectively. In some implementations, the first shaft 186*a* and the second shaft 186*b* may have a generally circular profile with one or more flats (e.g., D-shaped) on at least a portion of an outer perimeter thereof, with a complementary profile on an inner passage of the forming rollers 110*a*, 110*b*, which may enhance torque transfer.

Each cassette 174 of forming rollers 110 may further include a first number of bearings 190*a*, 190*b* (visible in FIG. 9) that rotatably mount the first shaft 186*a* to the first block 184*a* of the respective cassette 174 of forming rollers 110 and a second number of bearings 190*c*, 190*d* (visible in FIG. 9) that rotatably mount the second shaft 186*b* to the second block 184*b* of the respective cassette 174 of forming rollers 110. In the illustrated implementation, a first or outer set of bearings 190*a* and a second or inner set of bearings 190*b* rotatably mount the first shaft 186*a* for rotation about a first shaft rotational axis 192*a*, and a third or outer set of bearings 190*c* and a fourth or inner set of bearings 190*d* rotatably mount the second shaft 186*b* for rotation about a second shaft rotational axis 192*b*, the second shaft rotational axis 192*b* parallel to the first shaft rotational axis 192*a*.

Each cassette 174 of forming rollers 110 may include a first bearing race 202*a*, a second bearing race 202*b*, a third bearing race 202*c* and a fourth bearing race 202*d* (visible in FIG. 9). The first bearing race 202*a* may retain and provide a track for the first or outer set of bearings 190*a*. The second bearing race 202*b* may retain and provide a track for the second or inner set of bearings 190*b*. The third bearing race 202*c* may retain and provide a track for the third or outer set of bearings 190*c*. The fourth bearing race 202*d* may retain and provide a track for the fourth or inner set of bearings 190*d*. The first bearing race 202*a* and the first or outer set of bearings 190*a* may comprise a front tapered roller bearing, angled radially outward as traversed from back to front. The second bearing race 202*b* and the second or inner set of bearings 190*b* may comprise a back tapered roller bearing, angled radially outward as traversed from front to back. The third bearing race 202*c* and the third or outer set of bearings 190*c* may comprise a front tapered roller bearing, angled radially outward as traversed from back to front. The fourth bearing race 202*d* and the fourth or inner set of bearings 190*d* may comprise a back tapered roller bearing, angled radially outward as traversed from front to back.

Each cassette 174 of forming rollers 110 may include a first back bearing housing 204*a* to house the second bearing race 202*b* and the second or inner set of bearings 190*b*. Each cassette 174 of forming rollers 110 may include a second back bearing housing 204*b* to house the fourth bearing race 202*d* and the fourth or inner set of bearings 190*d*. Each cassette 174 of forming rollers 110 may include a first and a second front lip seal 206*a*, 206*b* (visible in FIG. 9) positioned to respectively seal the first bearing race 202*a* and the first or outer set of bearings 190*a* and the third bearing race 202*c* and the third or outer set of bearings 190*c* from the external environment, preventing or resisting ingress of debris. Each cassette 174 of forming rollers 110 may include a first and a second back lip seal 208*a*, 208*b* (visible in FIG. 9) positioned to respectively seal the first back bearing housing 204*a* and second back bearing housing 204*b*, along with the second or inner set of bearings 190*b* and the second bearing race 202*b* and the fourth or inner set of bearings 190*d* and the fourth bearing race 202*d* from the external environment, preventing or resisting ingress of debris.

Each cassette 174 of forming rollers 110 may include retainers 198*a*, 198*b* (best visible in FIGS. 7 and 9) and/or lock nuts 200*a*, 200*b* (best visible in FIGS. 7 and 9) attached to inner ends of the first shaft 186*a* and the second shaft 186*b* to secure the first and the second back bearing housings 204*a*, 204*b*, respectively, to the first shaft 186*a* and the second shaft 186*b*, respectively, with the second or inner set of bearings 190*b* and the fourth or inner set of bearings 190*d* housed and protected by the first and the second back bearing housings 204*a*, 204*b*.

The respective cassette frame 180 of each cassette 174 is rectangular (i.e., two sides of equal length and two side of equal length but of a different length than the other two sides; or four sides of equal length) and has four corners or outer end points 201*a*, 201*b*, 201*c*, 201*d* (called out in FIG. 7). The cassette frame 180 comprises a number of attachment points 194, for example six attachment points 194, one attachment point 194 at each of the four corners of the cassette frame 180 and one attachment point 194 at each of two intermediary locations between respective pairs of the four corners of the cassette frame 180. The attachment points 194 allow the cassette 174 of forming rollers 110 to be detachably coupleable to a turret assembly 104 as a unit, for example via a plurality of fasteners.

The first chain sprocket 188*a*, the first forming roller 110*a*, the second chain sprocket 188*b*, and the second forming roller 110*b* of the cassette 174 are accessible from the exterior 140 of the turret assembly 104 without dismantling of the turret assembly 104 while the respective cassette 174 of forming rollers 110 is physically mounted to the turret assembly 104.

Each of the first and the second blocks 184*a*, 184*b*, respectively, of each cassette 174 of forming rollers 110 are slideably mounted in the cassette frame 180 of the respective cassette 174 of forming rollers 110 to translate along an axis 210 (FIGS. 7 and 8) that extends between the respective first and second forming rollers 110*a*, 110*b* of the respective cassette 174 of forming rollers 110. Each cassette 174 of forming rollers 110 may include one or more springs 196 (one shown per cassette 174 in FIG. 9) positioned between the first and the second blocks 184*a*, 184*b* of the cassette 174 of forming rollers 110 to bias the first and second blocks 184*a*, 184*b* apart. The springs 196 may take any of a variety of forms, for example coil springs, compression springs, springs and/or leaf spreading die springs. The springs 196 may be secured to the first and the second blocks 184*a*, 184*b*, for example by extending partially into apertures (not shown) in the first and the second blocks 184*a*, 184*b* that are sized and shaped to hold respective ends of the springs 196.

Each cassette 174 of forming rollers 110 comprises at least one adjustment mechanism operable to selectively adjust a positioned of the first and the second blocks 184*a*, 184*b* of the cassette 174 of forming rollers 110 along the axis 210 that extends between the respective first and second forming rollers 110*a*, 110*b* of the respective cassette 174 of forming rollers 110. In the illustrated implementation, the at least one adjustment mechanism includes two distinct adjustment mechanisms, one operable to selectively adjust a positioned of the first block 184*a* in the frame 182 of the cassette 174 and one operable to selectively adjust a positioned of the second block 184*b* in the frame 182 of the cassette 174. In the illustrated implementation, each of the two distinct adjustment mechanisms respectively include an elongated threaded member (e.g., screw, bolt) 214*a*, 214*b* received though an aperture (e.g., threaded aperture) in a portion of the frame 182 with an inner end that physically engages (e.g., bears on) a portion of the respective one of the sliding blocks 184*a*, 184*b*, and a threaded fastener 216*a*, 216*b* (e.g., nut, lock nut), which are operable to selectively adjust the positioned of the first block 184*a* and the second block 184*b*, respectively, of the cassette 174 of forming rollers 110 along the axis 210 that extends between the respective first and second forming rollers 110*a*, 110*b* of the cassette 174 of forming rollers 110. Such may advantageously allow a spacing between the forming rollers 110 of each pair 108 to be manually adjusted as desired for a particular roll forming operation. Such may also advantageously allow the position (e.g., elevation) of the pair 108 of forming rollers 110 to be adjusted with respect to the location of the input feed 116*a* and/or output feed 116*b* and/or with respect to successive pairs 108 of forming rollers 110 in a set 106.

Preferably, the first forming roller 110*a*, the first chain sprocket 188*a*, the second forming roller 110*b*, and the second chain sprocket 188*b* of the cassette 174 are accessible from the exterior 140 of the turret assembly 104, for example with at most removal of a chain guard 150 and without dismantling of the turret assembly 104 to allow easy mounting to and dismounting from (e.g., changeover or replacement) of cassettes 174 of forming rollers 110 the turret assembly 104.

A method of operation of a roll forming machine 100 is described below, according to at least one illustrated implementation. It is noted that in operation one or more acts may be omitted, one or more acts added, and/or one or more acts performed in a different order that the order set out below.

Based on a desired cross-sectional profile of a workpiece, a first set 106 of pairs 108 of forming rollers 110 are selected. Assuming that the first set 106 of pairs 108 of forming rollers 110 are already mounted on a turret assembly 104, the turret assembly 104 is rotated, for example, to align the first set 106 of pairs 108 of forming rollers 110 with at least one of a location of an input feed 116*a* from which material will be feed and/or a location of an output feed 116*b* to which roll formed material will be deposited.

At least a portion of a transmission 114 is coupled to the first set 106 of pairs 108 of forming rollers without dissembling the turret assembly 104. For example, a forming roller drive chain 142 may be manually coupled to chain sprocket 188*a*, 188*b* that drive the forming rollers 110 of the first set 106 of forming rollers 110. Such may include removing a chain guard 150 if present in order to couple the transmission 114 with the first set 106 of pairs 108 of forming rollers 110, and subsequent placement of the chain guard 150 once the portion of the transmission 114 has been coupled to the first set 106 of pairs 108 of forming rollers 110, all without disassembling or dismantling of the turret assembly 104.

The workpiece (e.g., stock material) is feed to the first set 106 of pairs 108 of forming rollers 110 while the first set 106 of pairs 108 of forming rollers 110 are driven via the transmission 114 (e.g., forming roller drive chain 142, transfer shafts 144*a*, 144*b*, main drive chain 146, gear reducer 148) to produce a first cross-sectional profile in the workpiece.

Based on a desired cross-sectional profile of a second workpiece or further rolling forming on the previously roll formed workpiece, a second set of pairs 108 of forming rollers 110 are selected. Assuming that the second set of pairs 108 of forming rollers 110 are already mounted on a turret assembly 104, at least a portion of the transmission 114 (e.g., forming roller drive chain 142) is decoupled from the first set 106 of pairs 108 of forming rollers 110 without dissembling the turret assembly 104, and the turret assembly 104 is rotated to align a second set of pairs 108 of forming rollers 110 with at least one of the location of the input feed 116*a* and/or the location of the output feed 116*b*. Decoupling the portion of transmission 114 (e.g., forming roller drive chain 142) from the first set 106 of pairs 108 of forming rollers 110 may include removing a chain guard 150 if present, but does not employ disassembling or dismantling of the turret assembly 104.

At least a portion of the transmission 114 (e.g., forming roller drive chain 142) is coupled to the second set of pairs 108 of forming rollers 110 without dissembling the turret assembly 104. Subsequently the chain guard 150 may be reattached once the portion of the transmission 114 has been coupled to the second set of pairs 108 of forming rollers 110, all without disassembling or dismantling of the turret assembly 104.

The workpiece (e.g., stock material) is feed to the second set 106 of pairs 108 of forming rollers 110 while the second set of pairs 108 of forming rollers 110 are driven via the transmission 114 (e.g., forming roller drive chain 142, transfer shafts 144*a*, 144*b*, main drive chain 146, gear reducer 148) to produce a second cross-sectional profile.

In some instances, the sets 106 of pairs 108 forming rollers 110 on a turret assembly 104 may not include the one or more pairs of forming rollers 110 to achieve a desired cross-sectional profile, or one or more of the forming rollers 110 may be worn, or other components (e.g., chain sprockets 188*a*, 188*b*, forming roller shafts 186*a*, 186*b*, bearings 190*a*, 190*b*, 190*c*, 190*d*) may be worn or otherwise require servicing.

In such instances, one or more sets 106 of pairs 108 forming rollers 110 on the turret assembly 104 may be replaced. For example, one or more pairs 108 of existing forming rollers 110 of one set 106 on the turret assembly 104 may be detached, for example by removal of one or more fasteners (e.g., bolts, nuts, screws, clamps) and subsequent detachment or removal of a cassette 174. Then one or more pairs 108 of replacement forming rollers 110 may attached in respective positions in the one set 106 on the turret assembly 104, for example by placement of a replacement cassette 174 and securing the replacement cassette 174 to the turret assembly 104 at the desired position via one or more fasteners (e.g., bolts, nuts, screws, clamps). At least a portion of the transmission 114 (e.g., forming roller drive chain 142) may be physically coupled (e.g., mounted) to respective chain sprockets 188*a*, 188*b* of the plurality of cassettes 174 of forming rollers 110 physically coupled to the turret assembly 104 without dissembling the turret assembly 104. Replacement may employ removal of chain guard 150, but can advantageously be achieved with disassembling the turret assembly 104.

Figure 10:
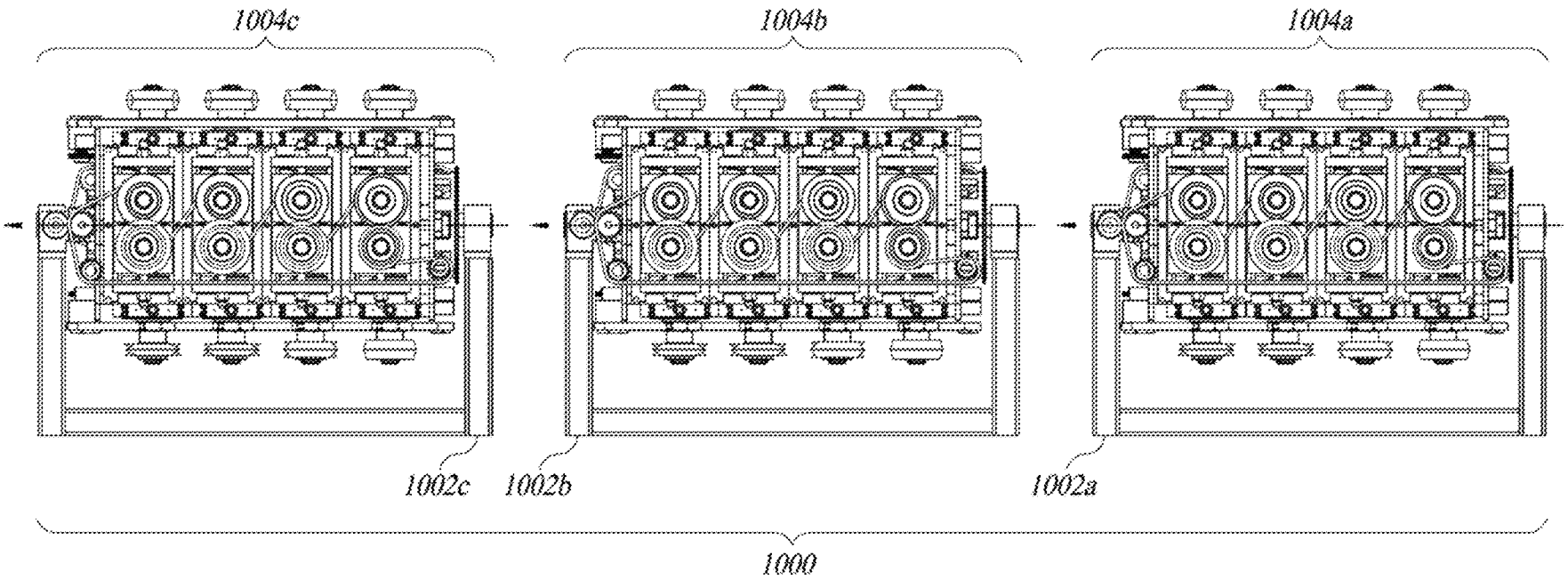
FIG. 10 shows a roll forming machine installation comprising a plurality of turret assemblies, according to at least one illustrated implementation.

FIG. 10 shows a roll forming machine installation 1000, according to at least one illustrated implementation.

The roll forming machine installation 1000 may include one or more frames 1002*a*, 1002*b*, 1002*c* (three illustrated). The roll forming machine installation 1000 may include a first turret assembly 1004*a* rotatably mounted to the one or more frames 1002*a* between a location of an input feed and a location of an output feed. The roll forming machine installation 1000 may include a second turret assembly 1004*b* rotatably mounted to the one or more frames 1002*b* and located downstream of the first turret assembly 1004*a* (i.e., relatively closer to the location of the output feed as compared to the position of the first turret assembly 1004*a*). The roll forming machine installation 1000 may include a third turret assembly 1004*c* rotatably mounted to the one or more frames 1002*c* and located downstream of the second turret assembly 1004*b* (i.e., relatively closer to the location of the output feed as compared to the position of the second turret assembly 1004*b*). While not illustrated, the roll forming machine installation may include a fourth turret assembly, or even more turret assemblies, for example located successively downstream of one another.

The roll forming machine installation 1000 advantageously allows selection from a large number of roll forming operations to be performed employing minimal changeover and lost time.

While not illustrated, a roll forming machine installation may include a plurality of turret assemblies mounted to a carousel turret assembly. Such a roll forming machine installation may include a frame and a carousel turret assembly mounted to the frame. The carousel turret assembly has a carousel turret rotational axis about which the carousel turret assembly rotates with respect to the frame.

The roll forming machine installation may include a first turret assembly, a second turret assembly, and possibly a third, a fourth and even more turret assemblies. The first, second, third, fourth or even more turret assemblies are each mounted to rotate with the carousel turret assembly about the carousel turret rotational axis. The first, second, third, fourth or even more turret assemblies are each mounted to rotate about respective rotational axes of the first, second, third, fourth or even more turret assemblies, the respective rotational axes of the first, second, third, fourth or even more turret assemblies which themselves rotate about the carousel turret rotational axis of the carousel turret assembly. Rotation of the carousel turret assembly allows any one of the first, the second, the third, the forth or more turret assemblies to be selected, and rotation about a respective one of the first, the second, the third, the fourth or more turret axes allows any one of a plurality of sets of one or more pairs of forming rollers of the selected one of the first, the second, the third, the fourth or more turret assemblies to be aligned with a location of an input feed and/or a location of an output feed of the roll forming machine installation.

Figure 11:
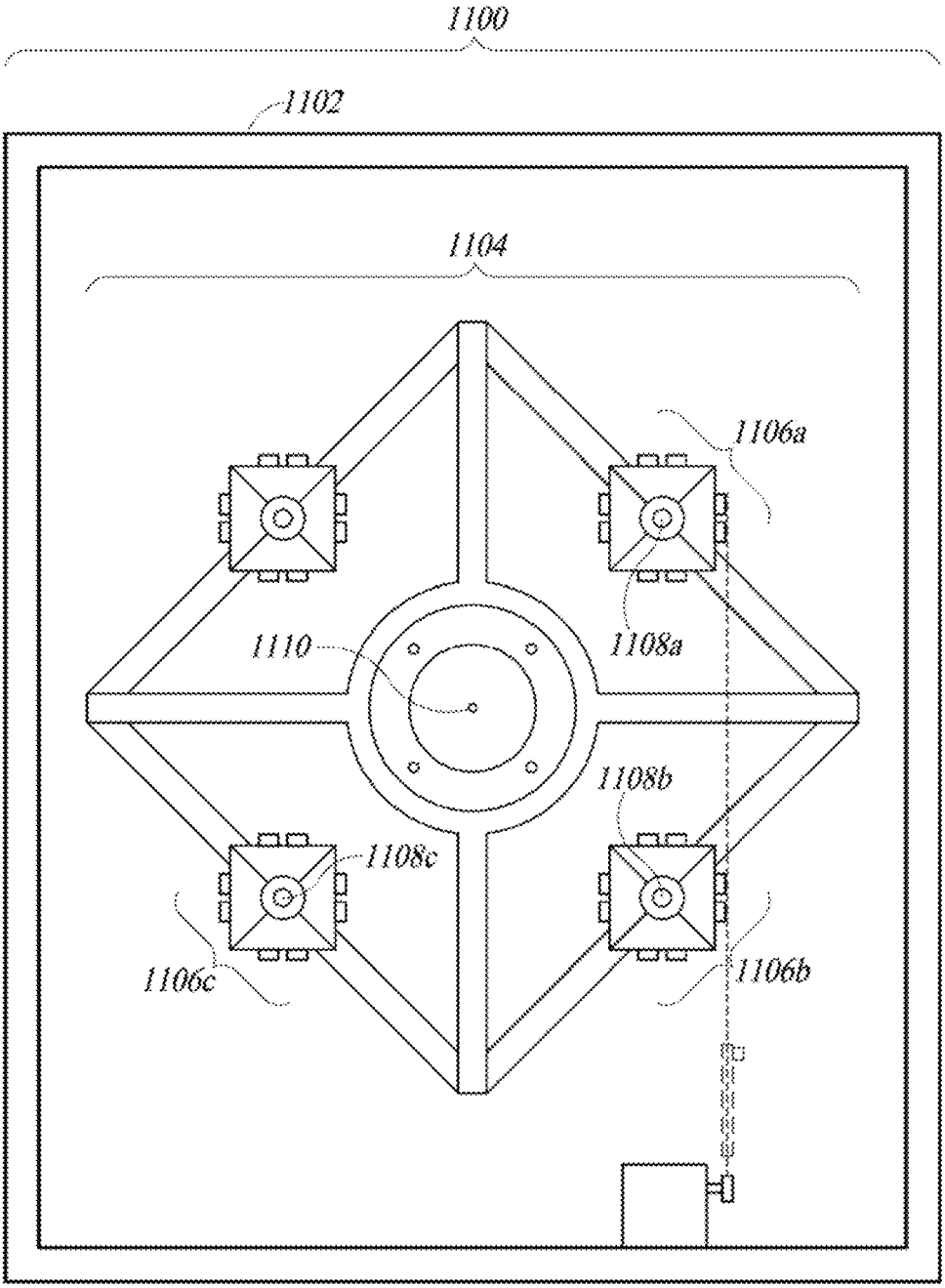
FIG. 11 is a schematic view of a roll forming machine include a carousel turret assembly, according to at least one illustrated embodiment.

FIG. 11 shows a roll forming machine 1100 according to at least one illustrated embodiment.

The roll forming machine 1100 includes a carousel frame 1102 and a carousel turret assembly 1104 rotatably mounted to the carousel frame 1102.

The carousel turret assembly 1104 carries a first turret assembly 1106*a* having a first turret rotational axis 1108*a*, the first turret assembly 1106*a* rotatable about the first turret rotational axis 1108*b*, a second turret assembly 1106*b* having a second turret rotational axis 1108*b*, the second turret assembly 1106*b* rotatable about the second turret rotational axis 1108*b*; and at least a third turret assembly 1106*c* having a third turret rotational axis 1108*c*, the third turret assembly 1106*c* rotatable about the third turret rotational axis 1108*c*. The first, the second and at least the third turret assemblies 1106*a*, 1106*b*, 1106*c* can be similar or even identical to the previously described and illustrated turret assemblies.

The carousel turret assembly 1104 has a carousel turret rotational axis 1110, the carousel turret assembly 1104 rotatably about the carousel turret rotational axis 1110 with respect to the carousel frame 1102, wherein the first turret assembly 1106*a*, the second turret assembly 1106*b*, and at least the third turret assembly are each mounted to rotate with the carousel turret assembly 1104 about the carousel turret rotational axis 1110, wherein rotation of the carousel turret assembly 1104 allows any one of the first, the second or at least the third turret assemblies 1106*a*, 1106*b*, 1106*c* to be selected, and rotation about a respective one of the first, the second or at least the third turret axes allows any one of a plurality of sets of one or more pairs of forming rollers of the selected one of the first, the second or the third turret assemblies to be aligned with an input and an output of the roll forming machine 1100.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art.

Many of the methods described herein can be performed with variations. For example, many of the methods may include additional acts, omit some acts, and/or perform acts in a different order than as illustrated or described.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The various implementations described above can be combined to provide further implementations. All of the commonly assigned US patent application publications, US patent applications, foreign patents, and foreign patent applications referred to in this specification and/or listed in the Application Data Sheet are incorporated herein by reference, in their entirety, including but not limited to U.S. Provisional Application No. 63/212,360, filed Jun. 18, 2021, or U.S. application Ser. No. 17/842,921, filed Jun. 17, 2022.

The invention claimed is:

1. A roll forming machine, the roll forming machine comprising:

a first turret assembly having a first turret rotational axis, the first turret assembly rotatable about the first turret rotational axis;

a first set of two or more pairs of forming rollers mountable to the first turret assembly, the two or more pairs of forming rollers of the first set sequentially arranged extending along the first turret rotational axis, the two or more pairs of forming rollers of the first set spaced longitudinally from one another along the first turret rotational axis, the forming rollers of the first set laterally spaced outwardly from the first turret rotational axis in a first lateral direction, the forming rollers of each pair in the first set arranged to complementarily cooperate with one another to perform a respective rolling forming operation, the two or more pairs of forming rollers of the first set arranged along the first turret rotational axis to successively perform respective roll forming operations;

at least a second set of two or more pairs of forming rollers mountable to the first turret assembly, the two or more pairs of forming rollers of the second set sequentially arranged extending along the first turret rotational axis, the two or more pairs of forming rollers of the second set spaced longitudinally from one another along the first turret rotational axis, the forming rollers of the second set laterally spaced outwardly from the first turret rotational axis in a second lateral direction, the second lateral direction different from the first lateral direction, the forming rollers of each pair in the second set arranged to complementarily cooperate with one another to perform a respective rolling forming operation, the two or more pairs of forming rollers of the second set arranged along the first turret rotational axis to successively perform respective roll forming operations, wherein the forming rollers of the first set of two or more pairs of forming rollers and the forming rollers of the second set of two or more pairs of forming rollers are mounted to rotate in unison with the first turret assembly about the first turret rotational axis;

a second turret assembly having a second turret rotational axis, the second turret assembly rotatably about the second turret rotational axis;

a drive motor; and a transmission that drivingly couples the drive motor selectively to the forming rollers of the first or at least the second set of one or more pairs of forming rollers of at least the first turret assembly, the transmission accessible from an exterior of the first turret assembly without dismantling of the first turret assembly.

2. The roll forming machine of claim 1, wherein the transmission is positioned externally to the first turret assembly.

3. The roll forming machine of claim 1, wherein the transmission comprises a forming roller drive chain, and further comprising a chain guard detachably coupleable to the first turret assembly to overlie the forming roller drive chain, the forming roller drive chain positioned externally to the first turret assembly and manually engageable selectively with the forming rollers of the first or at least the second set of one or more pairs of forming rollers with removal of the chain guard and without dismantling of the first turret assembly.

4. The roll forming machine of claim 3, wherein the transmission further comprises one or more transfer shafts and a main drive chain drivingly coupled between the drive motor and the one or more transfer shafts, and wherein the forming roller drive chain is drivingly coupled between the one or more transfer shafts and a selected one of the first or at least the second set of one or more pairs of forming rollers, the one or more transfer shafts and the main drive chain accessible from the exterior of the first turret assembly without dismantling of the first turret assembly.

5. The roll forming machine of claim 4, wherein the transmission further comprises a gear reducer drivingly coupled between the drive motor and the main drive chain, the gear reducer accessible from the exterior of the first turret assembly without dismantling of the first turret assembly.

6. The roll forming machine of claim 1, wherein the first turret assembly comprises a tube mounted to rotate about the first turret rotational axis, the tube being a unitary structure.

7. The roll forming machine of claim 6, wherein the tube is a weldment, or a cast metal or extrusion single-piece construction.

8. The roll forming machine of claim 6, wherein the first turret assembly further comprises at least one shaft that is coaxial with the first turret rotational axis, the tube is a cylindrical tube, and the at least one shaft is received through a central passage of the cylindrical tube.

9. The roll forming machine of claim 6, wherein, the first turret assembly comprises a plurality of brackets that extend laterally outwardly from an outer perimeter of the tube, each of the brackets comprising a number of attachment features, the attachment features positioned and operable to allow detachably coupling of each of a number of cassettes of forming rollers to the first turret assembly, each cassette of forming rollers detachably coupleable as a unit via a number of fasteners.

10. The roll forming machine of claim 9, wherein the brackets and the tube are a unitary structure, and when each cassette of forming rollers is detachably coupleable to a respective pair of the brackets, the pair of brackets and the respective cassettes of forming rollers form a triangular structure.

11. The roll forming machine of claim 10, wherein the first turret assembly further comprises a plurality of tie rods that extend laterally from the tube, the tie rods which detachably couple the cassette of forming rollers to the tube.

12. The roll forming machine of claim 1, wherein:

the second turret assembly is rotatably mounted to a frame and located downstream of the first turret assembly.

13. The roll forming machine of claim 1, further comprising:

a third turret assembly having a third turret rotational axis, the third turret assembly rotatably about the third turret rotational axis; and a carousel turret assembly mounted to a frame, the carousel turret having a carousel turret rotational axis, the carousel turret assembly rotatably about the carousel turret rotational axis with respect to the frame, wherein the first turret assembly, the second turret assembly and the third turret assembly are each mounted to rotate with the carousel turret assembly about the carousel turret rotational axis, wherein rotation of the carousel turret assembly allows any one of the first, the second or the third turret assemblies to be selected, and rotation about a respective one of the first, the second or the third turret axes allows any one of a plurality of sets of one or more pairs of forming rollers of the selected one of the first, the second or the third turret assemblies to be aligned with an input and an output of the roll forming machine.

14. A method of operation of a roll forming machine, the method comprising:

physically coupling each of a plurality of cassettes of forming rollers of a first set of two or more pairs of forming rollers to a turret assembly at respective positions on the turret assembly;

rotating the turret assembly to align the first set of two or more pairs of forming rollers with at least one of an input feed location or an output feed location, the two or more pairs of forming rollers of the first set spaced longitudinally from one another along a first turret rotational axis;

coupling at least a portion of a transmission to the first set of two or more pairs of forming rollers without dissembling the turret assembly;

feeding stock material to the first set of two or more pairs of forming rollers while the first set of two or more pairs of forming rollers are driven via the transmission to produce a first cross-sectional profile;

rotating the turret assembly to align a second set of two or more pairs of forming rollers with at least one of the input feed location or the output feed location, the two or more pairs of forming rollers of the second set paced longitudinally from one another along the first turret rotational axis, coupling at least a portion of the transmission to the second set of two or more pairs of forming rollers without dissembling the turret assembly;

feeding stock material to the second set of two or more pairs of forming rollers while the second set of two or more pairs of forming rollers are driven via the transmission to produce a second cross-sectional profile.

15. The method of claim 14, further comprising:

removing a chain guard from the turret assembly before coupling at least a portion of the transmission to the second set of two or more pairs of forming rollers without dissembling the turret assembly; and reattaching the chain guard to the turret assembly before feeding stock material to the second set of two or more pairs of forming rollers while the second set of two or more pairs of forming rollers are driven via the transmission to produce a second cross-sectional profile.

16. The method of claim 14, further comprising:

coupling at least a portion of the transmission to respective sprockets of the plurality of cassettes of the forming rollers of the first set of two or more pairs of forming rollers physically coupled to the turret assembly without dissembling the turret assembly.

17. The method of claim 14, further comprising:

physically replacing a first set of a plurality of cassettes of the forming rollers of the first set of two or more pairs of forming rollers on the turret assembly with a second set of a plurality of cassettes of forming rollers.

18. The method of claim 17, further comprising:

coupling at least a portion of the transmission to respective sprockets of the second set of the plurality of cassettes of forming rollers physically coupled to the turret assembly without dissembling the turret assembly.

* * * * *